United States Patent [19]

Weiss

[11] 3,951,042

[45] Apr. 20, 1976

[54] APPARATUS FOR STROKE CONTROL IN HIGH PRESSURE MACHINERY

[76] Inventor: Adolf F. Weiss, 645 Arndt Road, Easton, Pa. 18042

[22] Filed: Mar. 29, 1974

[21] Appl. No.: 456,361

[52] U.S. Cl. ..... 91/363 R; 60/428; 91/27; 91/393; 91/450; 92/114

[51] Int. Cl.[2] ..... F15B 9/09

[58] Field of Search ..... 91/393, 361, 35, 27, 91/400, 407, 410, 20, 363 R; 83/639; 100/269 R; 92/13.8, 113; 60/421, 428, 429, 486; 251/321

[56] References Cited

UNITED STATES PATENTS

| | | | |
|---|---|---|---|
| 1,595,939 | 8/1926 | Hukill et al. | 92/129 X |
| 2,567,715 | 9/1951 | Keusch et al. | 91/27 X |
| 2,623,501 | 12/1952 | Audemar | 251/321 X |
| 2,923,973 | 2/1960 | Ninneman | 91/393 X |
| 2,960,304 | 11/1960 | Goss | 251/321 X |
| 2,983,956 | 5/1961 | Vogel, Jr. et al. | 91/393 |
| 2,994,303 | 8/1961 | Robra et al. | 91/407 X |
| 3,407,710 | 10/1968 | Weiss | 92/13.8 |
| 3,827,328 | 8/1974 | LaFlamme et al. | 83/639 X |

*Primary Examiner*—C. J. Husar
*Assistant Examiner*—Edward Look
*Attorney, Agent, or Firm*—Roylance, Abrams, Berdo & Kaul

[57] ABSTRACT

Apparatus for controlling the stroke of the movable member in a high pressure hydraulic machine, such as a hydraulic press, to permit the member to be positioned to an accuracy of 0.0005 inch and held at such position for a preselected time. The movable member is coupled to a piston movable within a cylinder which receives pressurized fluid. An adjustable threaded rod and nut arrangement is movable by movement of the piston within the cylinder, and an extension of the rod carries an actuating device for sequentially operating a first and then second valve. Operation of the first valve greatly reduces the speed of the movable member and operation of the second valve stops the movable member at its exact predetermined position. An adjustable time delay is coupled with the output from the second valve to maintain the movable member at such position for a preselected time thus maintaining the pressure on the article being formed in the machine. When the time delay expires, the apparatus and hydraulic machine are reset.

27 Claims, 2 Drawing Figures

APPARATUS FOR STROKE CONTROL IN HIGH PRESSURE MACHINERY

Figure 1:
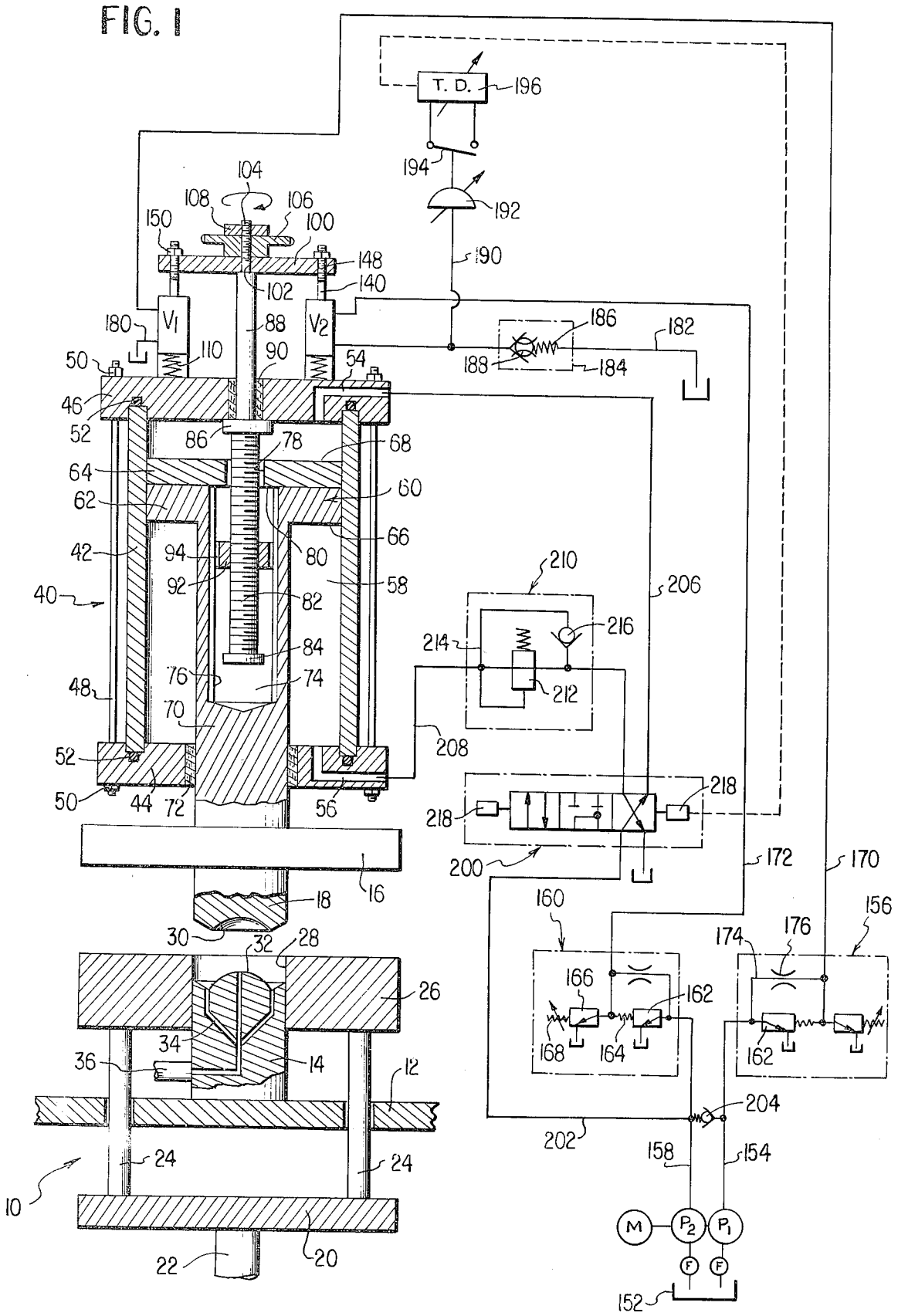

This invention relates to high pressure hydraulically operated machinery and in particular it relates to apparatus for controlling the stroke of a movable member in such a high pressure hydraulic machine, such as a hydraulic press. Still more particularly, this invention relates to an apparatus for controlling the stroke of the movable member in a high pressure hydraulic machine, such as a hydraulic press, to permit such movable member to be positioned to an accuracy of 0.0005 inch and held at such position for a preselected period of time.

While the present invention need not be limited to any particular type of machine, it does find particular utility in connection with high pressure hydraulic presses used for compacting operations. Such presses generally include a pair of relatively movable punch members, which, when driven toward one another, tend to compress or compact a powder or slurry material therebetween to form an article of a desired size and shape. The powder or slurry material from which the article is formed is usually introduced into a cavity in a die plate. The cavity is generally an open hole extending completely through the die plate and a top punch member and bottom punch member fit within this opening in the die plate to compress or compact therebetween, the article to be formed. Obviously, under such circumstances, the final distance by which the top punch member is separated from the bottom punch member, the configuration of the faces of such punch members and the size of the opening or cavity in the die case serve to determine the configuration of the final article.

As has previously been explained in such patents as my prior U.S. Pat. No. 3,430,538 and my prior U.S. Pat. No. 3,555,965, and as will be apparent to those familiar with the compacting art, there are many variables which have an effect on the final configuration of the article to be formed. The most critical variable, however, is the stroke adjustment for the movable member since this adjustment, in effect, determines the distance between the top and bottom punch members as such members are disposed within the cavity in the die case. If, for example, the bottom punch member is fixed in position within the die case cavity and the upper punch member is movable, it becomes necessary to adjust the degree of movement of the upper punch member to a very high degree of accuracy, such as 0.0005 inch in order to be certain that the powder material in the cavity will be compacted to the proper degree of pressure. Another factor which is important, depending upon the nature of the powder or slurry material in the cavity, is the amount of time for which the pressure will be applied. That is, in certain instances, it is not only necessary to initially apply the pressure between the punch members in the cavity, but it is necessary to maintain such pressure for a sufficient length of time to permit the powder or slurry to set, cure, adhere or undergo whatever physical or chemical change is necessary and required before the article is fully formed.

One satisfactory form of stroke adjustment mechanism for use in apparatus of this type is that disclosed in my prior U.S. Pat. No. 3,407,710. In that patent, there is disclosed a stroke adjustment means in the form of an elongated threaded shaft and nut arrangement, adjustably mounted above a hydraulic cylinder and piston arrangement which controlled the position of the movable member in the hydraulic press. An arrangement such as that shown in my aforementiond U.S. Pat. No. 3,407,710 is operational and is effective for smaller forms of hydraulic presses. However, in the instance of a very large high pressure hydraulic machine, such an arrangement would be unsatisfactory for two reasons. The first reason, of course, is that the size of the threaded shaft and the nut, and the degree of accuracy to which such shaft and nut would have to be machined in order to accomplish satisfactory stroke adjustment, would be prohibitive. The size of the shaft itself could in some instances be huge and the threading on such shaft, and the fit of the nut on such threading, would have to be exceptionally accurately machined. Secondly, the height of a threaded shaft such as that shown in the aforementioned patent would have to be substantially equal to the height of the cylinder and piston means itself, and accordingly, for a very large machine, which would perhaps extend one or two storeys in height, the added provision of such a threaded shaft and nut stroke adjustment would mean that the height would be increased to perhaps 2 to 4 storeys in height. Naturally, the acceptability of a hydraulic machine would be somewhat less if it required installation in a space having a height of 4 storeys, as opposed to a height of 2 storeys.

With the foregoing in mind, it is, therefore, an object of the present invention to provide a new and improved apparatus for controlling the stroke of the movable member in a high pressure hydraulic machine, such as a hydraulic press used for compacting various types of articles.

Another object of the present invention is to provide means for very accurately and precisely controlling the stroke of a movable member in a hydraulically operated machine to position the movable member at the precise position desired and to maintain such member at such position for a predetermined period of time.

Another object of the present invention is to provide a highly efficient stroke adjustment mechanism for a hydraulic machine which is adaptable for all sizes of machines and which does not significantly increase the height of the machine over that which it would be if such stroke adjustment mechanism were eliminated.

Another object of the present invention is to provide a novel, efficient arrangement for controlling the stroke in a hydraulic compacting press so that the movable member stops at precisely the position desired and is retained at that position for precisely the period of time desired.

Other objects, advantages and salient features of the present invention will become apparent from the following detailed description, which, taken in conjunction with the annexed drawings, discloses a preferred embodiment of the invention.

Figure 2:
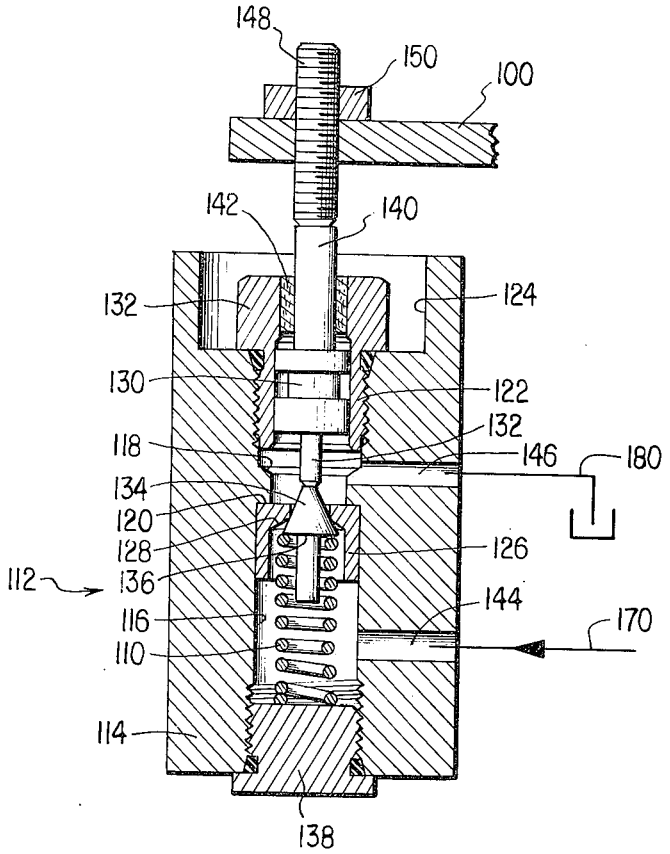

Referring to the drawings, which form a part of this original disclosure:

FIG. 1 is a diagrammatic view of apparatus in accordance with the principles of the present invention; and FIG. 2 is an enlarged sectional view of one of the valves utilized in the apparatus of the present invention.

Referring now to the drawings in greater detail, there is shown in FIG. 1 the operating portion of a suitable hydraulic machine generally designated 10 which is advantageously the high pressure hydraulic press type. Such a hydraulic machine includes a press table 12 which is normally fixed in position and which carries an upstanding punch member 14 thereon, the member 14 forming the lower punch member in the machine 10. An upper platen 16 carries a depending punch member 18, axially aligned with the punch member 14, and forming the upper punch member in the machine 10. A lower platen 20 is supported beneath the press table 12 by a suitable operating rod 22 which can be fixed in position or which can advantageously form the piston rod of a hydraulic cylinder and piston arrangement. Upstanding support rods 24 extend through aligned apertures in the press table 12 to support the die case or die plate 26. The die case 26 has a central aperture or bore 28 extending therethrough in alignment with the punch members 14 and 18 to thus form the cavity for the machine.

The upper platen 16 and the upper punch member 18 are movable, in a manner to be described hereinafter, so that the punch member 18 enters the cavity 28 but stays separated by a certain distance from the lower punch member 14. The confronting surfaces 30 and 32 on the upper and lower punch members respectively can be configured in the manner in which the final article is to be formed. The volume in the cavity 28 will, of course, be determined by the size of that cavity and the distance between the faces 30 and 32 on the respective punch members. This cavity is filled with a suitable powder or slurry material from which the final article is to be formed and when the punch members apply suitable pressure to such material, the article is formed within the cavity 28. If the article is to be formed of a slurry material, there is often a substantial amount of water in such material and it is necessary to drain such water from the slurry during the compacting operation. A series of drain bores 34 are thus formed in the lower punch member 14 and are connected with a conduit 36 which can be connected to a suitable reservoir or to a suitable vacuum source to withdraw the water from the slurry during the compacting operation.

A hydraulic cylinder and piston arrangement generally designated 40 is utilized for adjusting the upper platen 16 and the upper punch member 18 affixed thereto. The cylinder and piston arrangement 40 includes an elongated cylinder body 42 having a pair of opposed end members 44 and 46 connected therewith. A series of spaced tie rods 48 are used to couple the end members 44 and 46 with the cylinder body 42. The ends of these tie rods extend through the end members and nuts 50 are engaged on the extending ends. When these nuts are tightened, they tend to draw the end members 44 and 46 toward one another. Suitable sealing means such as O-rings 52 can be provided at the junction of the cylinder body and the end members to prevent leakage. A hydraulic port 54 is provided in the end member 46 and a similar hydraulic port 56 is provided in the end member 44, with such hydraulic port members being adapted to be connected to a source of pressurized hydraulic fluid in a manner to be described hereinafter. Each of the hydraulic ports communicates with the chamber 58 formed within the cylinder body 42 and betweenn the end members 44 and 46.

A piston means generally designated 60 is disposed within the chamber 58. For ease of manufacturing, the piston means 60 can be formed of a first member 62 and a second interconnected member 64, such members being attached together by any suitable means. As an alternative, the piston means can be fabricated as a single plate unit. As can be seen, the piston means 60 has a first working surface or face 66 directed toward the end member 44 and an opposed parallel working surface or face 68 directed toward the end member 46. An enlarged piston rod 70 is connected with the member 62 of the piston means and extends centrally therefrom through a central aperture in the end member 44 and connects with the upper platen 16. A suitable sealing device such as a bushing 72 closely surrounds the piston rod 70 as it projects through the opening in the end member 44 to asure that no hydraulic fluid will leak from the cavity 58 as the piston rod moves.

A blind bore 74 extends through the piston plate 62 and partially through the piston rod 70 and a pair of ribs 76 extend along the sides of this bore 74 to act as keys in a manner to be described hereinafter. A central aperture 78 is formed in the piston portion 64 and the size of this aperture 78 is somewhat smaller than the size of the bore 74. As a result, a shoulder 80 is formed at the interface of the piston portions 62 and 64.

A threaded rod 82 projects through the central aperture 78 and partially into the blind bore 74. This rod 82 terminates at a plate 84 at its lower end and at a plate 86 at its upper end, with the plate 86 abutting against the inner surface of the cylinder end member 46. An unthreaded extension rod 88 projects from the plate 86 outwardly through a central aperture in the end member 46 and this extension rod is surrounded by a suitable sealing means, such as a bushing 90, to prevent any leakage of hydraulic fluid.

A nut 92 is mounted on the threaded rod 82 and is movable axially along such rod when the rod and nut are rotated relatively to one another. The nut 92 is provided with a pair of channels 94 along the edges thereof through which the ribs 76 project. It can thus be seen that if the ribs 76 are considered keys, the slots or channels 94 are considered keyways, and as a result of this arrangement, while the nut 92 is movable axially within the bore 74, it is prevented from rotation therewithin. The screw threads on the rod 82 and on the nut 92 can be varied as desired, but in the illustrated form are of the buttress type.

A plate 100 is mounted upon the extension rod 88 at a point spaced a distance away from the outer surface of the end plate 46. The plate can abut against a shoulder 102 formed along a reduced diameter portion of the extension rod 88 or can be attached with the rod 88 by any other suitable means. A threaded end portion 104 on the rod 88 serves to mount a sprocket 106 which is held in position by means of a locking nut 108 engaged on the threaded portion 104. The sprocket or pinion 106 can be connected by a chain drive or by any other means to an adjustment mechanism which is capable of rotating the sprocket itself, the extension rod 88 and the threaded rod 82 in the manner illustrated by the arrow in FIG. 1. It should be readily apparent that rotation of the sprocket will cause a concomitant movement of the nut 92 axially along the threaded rod 82. When a suitable adjustment position has been reached, the rotation is terminated. At that point, it should be recognized that if high pressure hydraulic fluid is introduced through the hydraulic port 54 and applied against the end surface 68 of the piston means, the piston will move downwardly until the internal shoulder 80 thereof engages against the end surface of the nut 94. Thereafter, further movement of the piston means can occur only by movement of the threaded rod 82 and the nut 92 mounted thereon. As such movement occurs, the plate 86 moves inwardly from the end face of the end member 46 and the extension slides through the bushing 90. In a similar fashion, the plate 100 connected with the extension will be moved toward the end member 46, with such movement causing various operations which will be described in further detail hereinafter.

A pair of valve members designated V1 and V2 are provided between the end member 46 and the plate 100, as shown in FIG. 1. Each such valve member incorporates a biasing compression spring 110 illustated diagramatically in FIG. 1 and applying a biasing force to urge the plate member 100 away from the end member 46. The limits of this biasing force are controlled by engagement of the plate 86 against the inner surface of the end member 46.

The details of each valve member V1 and V2 are illustrated in FIG. 2 wherein each such valve member is generally designated 112. The valve member 112 includes a body 114 having a central bore 116 extending from the lower end thereof, merging into a reduced diameter bore portion 118 and thereby forming a shoulder 120, with the reduced diameter portion, in turn, merging into another bore portion 122 approximately the same size as the bore portion 116. The bore portion 122 communicates with a recess 124 formed at the upper end of the valve. A downwardly directed cup-shaped insert 126 is provided in the bore 116 to rest against the shoulder 120 and is provided with an upwardly tapering shoulder 128 which forms the valve seat. The valve member itself is formed by a spool 130 slidably disposed within a plug 132 which fits in the bore portion 122 and the recess 124. The valve further includes an extension 132 which carries thereon a gradually tapering frusto-conical portion 134 which actually acts as the valve member by engaging with the valve seat 128. The biasing spring 110, which was diagramatically illustrated in FIG. 1, is shown in FIG. 2 to be a compression spring reacting between the under surface 136 of the frusto-conical member 134 and an end plug 138 in the bore 110. The valve spool 130 carries a projecting pin 140 which is slidable within a sleeve 142 in the plug member 132. Finally, a pair of hydraulic ports are provided in the valve body 114, one port being designated 144 and communicating with the bore portion 116 and the other port being designated 146 and communicating with the bore portion 118. As such, it can be seen that the hydraulic ports 144 and 146 are located on opposite sides of the valve member, that the biasing spring 110 ordinarily urges the valve to a closed position by having the frusto-conical portion 134 held in engagement with the valve seat 128, but that the valve can be opened by applying a downward movement to the projecting pin 140 which in turn moves the spool member 130 and the shaft 132.

As can be noted from FIG. 2, a threaded pin 148 projects through the plate member 100 in alignment with the projecting pin 140 of each valve 112. A nut 150 is utilized to maintain the adjustment of the threaded pin relative to the plate 100 and it will be seen that the threaded pin 148 is aligned with, and the end thereof engageable with, the projecting pin 140 of the valve member. As a result, if the plate 100 is moved toward the valve member, as would occur when the piston applies a force against the nut 92 engaged on the threaded rod 82, then the threaded pin 148 will engage and push against the projecting pin 140 to overcome the biasing force of the spring 110 and to thus open the valve. For reasons which will become apparent hereinafter, it is important that the valves V1 and V2 not be opened simultaneously. Instead, the valve V1 is generally operated or opened approximately ⅛ inch to ⅜ inch before the valve V2 is operated. This is accomplished simply by adjusting the threaded pins 148 such that the one associated with the valve V1 is somewhat longer, by ⅛ to ⅜ inch than the one associated with the rod V2. As a result, when the plate 100 is moved toward the end member 46 of the cylinder, in the manner previously described, the valve V1 will be opened first and the valve V2 will be opened shortly thereafter.

If attention is now directed to the hydraulic flow circuit shown in FIG. 1, it will first be noted that the parts illustrated therein have been shown in accordance with U.S.A. Standard USAS Y 32.10 1967. In such flow diagram, a drive motor M serves to drive a pair of pumps designated P1 and P2, the former being a high volume low pressure pump and the latter being a low volume high pressure pump. Both pumps are connected through filters F to a tank or reservoir 152 which contains a supply of hydraulic fluid for the circuit. The pump P1 is connected by a flow line 154 with a master relief valve generally designated 156. In a similar fashion, the pump P2 is connected by a line 158 with a master relief valve generally designated 160. The valves 156 and 160 are identical and valves of this type are commercially available as differential pressure relief valves. Thus, while the particular details of the valves 156 and 160 do not form any part of the present invention, nevertheless the particular construction and operation of these valves is important as a part of the overall hydraulic circuit in the apparatus of the present invention. Each master relief valve 156 and 160 includes a differential pressure responsive valve 162 controlled by a biasing spring 164 which normally biases at 45 lbs per square inch. The valve 162 connects with a further valve 166 having a remote adjustable setting 168 which enables the opening pressure for the valve 166 to be selectively adjusted. The valves 162 and 166 are each connectable with a tank or reservoir, as illustrated. The output line from the relief valve 156 is designated 170 and the output line from the relief valve 160 is designated 172. Each of these output lines is connected between the valves 162 and 166. A by-path line 174 connects between each pump supply line 154 and 158, respectively, and the valve output lines 170 and 172 respectively. As a result, each line 174 bypasses the valve 162. This by-path line 174 contains a flow control orifice designated 176.

As will be noted, the line 170 connects with the input port 144 in the valve V1. The output port from the valve V1 is connected by a line 180 to the tank or reservoir. The output line 172 from the relief valve 160 is connected with the hydraulic port 144 in the valve V2. The output line connected with the hydraulic port 146 of the valve V2 is designated 182 and it too connects with a tank or reservoir. However, there is provided in the line 182 a check valve device 184 of the type which includes a spring biased check valve with the biasing spring 186 therein being adjusted to open under a pressure of 60 lbs per square inch. The check valve 184 has a very small orifice 188 formed therein, in the nature of 0.010 inches in diameter to act as a valve by-pass for purposes to be described hereinafter. A branch flow line 190 is connected between the flow line 182 and an adjustable pressure switch 192 normally operable at about 40 lbs per square inch. The pressure switch controls an electrical switch 194 engageable across a pair of electrical connections which, in turn, are connected with an adjustable time delay device 196.

Considering the hydraulic flow controls for the cylinder and piston assembly 40, it will be seen that the circuit includes a four-way solenoid operated self-centering valve generally designated 200. The valve 200 is of the conventional three-position type and the details thereof need not be described since they form no part of the present invention. As can be seen, the valve 200 is connected by a line 202 with the output lines 154 and 158 from the pumps P2 and P1. A spring bias check valve 204 is connected in the line 202 and between the lines 154 and 158, such check valve normally being operable at about 60 psi. The lines connecting the valve 200 with the cylinder and piston assembly 40 include a first line 206 connected with the hydraulic port 54 in the end member 46 and a second line 208 connected with the flow port 56 in the end member 44. A counterbalance valve device generally designated 210 is mounted in the line 208 when the machine is of the upright type. The counter balance valve 210 includes a spring loaded valve member 212 through which flow from the line 208 can pass once it reaches a certain pressure. Such flow would then continue through the main valve 200 to the tank. Before that particular pressure was reached, however, and the spring bias valve 212 was not opened, the flow would go around a bypath line 214 and be stopped by a check valve 216. The purpose for the counter balance 210 is to maintain a counter pressure under the piston 60 to maintain it at its position until a certain pressure is reached.

To understand and appreciate the operation of the device of the present invention, it will first be understood that certain adjustments must be made initially. Thus, the threaded pins 148 extending through the plate 100 are properly adjusted to assure that downward movement of the plate 100 will first operate the valve V1 and will subsequently operate the valve V2. Then, through adjustment of the pinion 106 which rotates the extension rod 88 and the threaded rod 92, the axial position of the nut 94 is properly determined. It will be recalled that engagement of the inner piston shoulder 80 against the top of the nut 92, as fluid pressure forces the piston means 60 downwardly, is what causes the threaded rod 82, the rod extension 88 and the plate 100 to be moved. This movement of the plate 100 will, in turn, through the threaded pins 148 engaging the projecting pins 140 of the valves, cause the valves to be opened and operated. The solenoids 218 which control the position of the four-way valve 200 are connected to the machine operating controls. When the machine is started, the motor M and the pumps P1 and P2 are operating to deliver hydraulic fluid from the reservoir 152. The remote valve setting devices 168 have been preset, with the valve setting device associated with the relief valve 156 being set to approximately 500 psi and the valve setting device associated with the relief valve 160 being set to a maximum pressure, in the neighborhood of 3,000 psi. When the solenoids 218 move the four-way valve 200 from its center position, the pump pressure from both the pump P1 and the pump P2 is delivered through the lines 154 and 158, through the line 202, through the four-way valve 200, through the line 206 and through the hydraulic port 54 into the chamber 58 in the cylinder, thus exerting a pressure against the top surface 68 of the piston means, thereby urging the piston downwardly. As the piston 60 moves downwardly, the inner shoulder 80 thereon will abut against the top of the nut 92 which will cause a downward pulling force on the threaded rod 82 and on the rod extension 88 which carries the plate 100. The plate 100 will be drawn toward the cylinder end member 46 and the projecting pin 148 associated with the valve V1 will strike the projecting pin 140 of that valve, thus overcoming the biasing force of the spring 110 and slightly opening the valve by unseating the frusto-conical portion 134 from the valve seat 128. Prior to opening of the valve V1, the flow from the pump P1 through the line 154 could not pass through the master relief valve 156 because the setting 168 of such valve was set for 500 psi and the flow from pump P1 was less than that. However, when the valve V1 opens the flow from the pump P1 passes directly through the master relief valve to the tank thereof thus causing a significant reduction in the speed of downward movement of the piston. The reason for this resides in the fact, previously mentioned, that the pump P1 is a high volume low pressure pump while the pump P2 is a low volume high pressure pump. Thus, as an example, if the flow from the pump P1 was 90 gallons and the flow from the pump P2 was 10 gallons, the original flow through the line 206 was the combined flow of 100 gallons. However, when the valve V1 opens the flow from the pump P1 is directed through the relief valve 156 to the tank, which means that only the 10 gallon flow from the pump P2 continues to be directed through the line 206 into the cylinder cavity to exert force on the piston. The purpose for this arrangement is to prevent high impact forces from occurring when the piston shoulder 80 contacts against the nut 82. Such high impact forces could occur, for example, by the wrong setting of the machine or by failure to insert the powder in the cavity or through some other misuse of the machine. If such forces did occur, they could break the nut 92, strip the threads on the rod 82, break the rod 82 itself or cause some other significant damage to the machine. However, with the aforementioned significant reduction in flow volume, the threaded rod 82 need only be able to withstand the 45 psi force controlled by the biasing spring 164 of the relief valve 156 when the shoulder 80 on the piston abuts against the nut 92.

It will be recalled that the adjustment of the threaded pins 148 assured that the valve V1 would be opened approximately ⅛ inch to ⅜ inches before the valve V2 is opened. This means that by the time the valve V2 is opened, the speed of downward movement of the piston means 60 will be significantly slowed down. As the valve V2 is opened, the flow pressure from the pump P2 goes through the master relief valve 160 and the line 172 and enters the valve V2 through the port 144 thereof, where the flow would initially be blocked because the valve would be closed. A very slight opening of the valve V2 as would occur by a very slight unseating of the conical portion 134 from the valve seat 128 will permit a slight flow through the line 172, thus reducing the pressure in that line and thus permitting the differential pressure valve 162 in the valve 160 to open slightly. This reduces the flow and the pressure through the line 206 and into the cylinder because a part of the flow from the pump P2 now passes through the line 158 and the valve 162 and into the tank associated with the relief valve 160. This flow reduction and pressure reduction through the line 206 effectively terminates any significant further downward pressure against the piston means 60, although there can be a very slight further increment of movement of the piston, such as in the nature of 0.0001 inch. However, even as that further minute increment of motion occurs the effect thereof is to cause further movement of the plate 100 and further opening of the valve V2 and the further that that valve is opened, the more pressure goes through the valve 162 to the tank and the less goes through the line 206. Thus, after a very slight additional incremental motion, the valve V2 will be opened enough to equalize the pressure whereupon all further movement of the piston means 60 will stop.

At this point it should be explained that the ratio of valve opening of the valve 162 as compared with the valve opening of valve V2 is much greater. That is, a very slight opening of the valve V2 causes a much faster opening of the valve 162 which, in turn, causes a much greater pressure reduction in the pressure of the hydraulic fluid being delivered through the line 158 by the pump P2. No matter how much additional pressure is applied, it would simply cause a greater opening of the valve V2 and, in turn, a greater opening of the valve 162 so that more flow would go to the pump.

As a result of the arrangement thus far described, if the particular pressure which was desired to be exerted on the powder or slurry material in the cavity 28 was 2,000 psi, the apparatus thus far described would reach and hold that pressure and would keep the punch members at their precise forming position. That is, the punch members would reach a certain position, as predetermined, and would hold that position thereby applying a preselected force on the powder or slurry material, with that force assisting in the setting or curing of the article.

However, it is also important to note that as the valve V2 is opened, the output thereof in the form of hydraulic fluid passing out through the port 146, enters and passes through the line 182 at a relatively low pressure. It was previously mentioned that the biasing force of the spring 186 in the back pressure check valve 184 is such that the valve will not open until the pressure reaches about 60 psi whereas the pressure switch 192 operates at approximately 40 psi, a somewhat lower pressure. Nevertheless, because of the provision of the small orifice 188 through the check valve, a certain pressure flow through the line 182 can go through the check valve 184 to the tank. However, because the orifice 188 is very small, there will be a build up in pressure on the forward side of the check valve 184 and that pressure build up will be transmitted through the branch line 190 until the pressure reaches 40 psi or whatever setting the pressure switch 192 is preset at, thereby causing the switch 194 to close. Since the switch 194 is connected with an adjustable time delay 196, the setting on this time delay controls the amount of time that the cylinder and piston assembly continue to stay at their final positions, thus exerting force on the article to be formed. If no dwell time is needed, the time delay can simply be set to zero. As the pressure through the line 182 increases to a significant enough degree to overcome the biasing effect of the spring 186, then the check valve 184 is opened so that the flow from the valve V2 can go to the tank.

The time delay 196 is electrically connected to the controls for the machine functions. Thus, when the time delay which has been preset elapses, which would occur when the pressure has been maintained on the article for a preselected period of time, then a signal is transmitted through the machine functions and back to the solenoids 218, as shown by the dashed line, to shift the main control valve 200 back to its center position, thereby releasing the pressure on the cylinder. That is, no further pressure will be delivered through the line 206 and that pressure which is already in the cylinder will be released through the line 208 to the tank. The provision of the orifice 188 in the back pressure check valve 184 serves to assure that pressure in the line 182 will be released, thereby permitting the valve V2 to reset and the pressure switch 192 to reset. When all such pressure has been released, then the biasing springs 110 will close the valves V1 and V2 and will push upwardly on the projecting pins 148 through the plate 100 to restore that plate and hence the piston to the initial position.

After reading the foregoing detailed description, it should be apparent that the objects set forth at the outset hereof have been successfully achieved by the present invention. While various changes and modifications in the system described herein may be apparent to those skilled in the art, such changes and modifications should be considered to be within the spirit and scope of the appended claims.

What is claimed is:

1. Stroke controlling apparatus for a movable member in a high pressure hydraulic machine, comprising:

a cylinder and piston assembly including:
cylinder means, and
a piston movable within said
cylinder means;

an elongated member having a first portion engageable with said piston and having a second portion spaced from said first portion;

hydraulic supply means for supplying hydraulic fluid to said cylinder and piston assembly;

first valve means and second valve means connected with said hydraulic supply means;

valve actuating means connected to said second portion of said elongated member;

said elongated member and said valve actuating means connected therewith being movable relatively to said first valve means and said second valve means as the hydraulic fluid moves the piston within said cylinder and piston assembly;

said valve actuating means being operative, upon movement, to initially operate said first valve means and to subsequently operate said second valve means;

said first valve means, when operated, serving to significantly reduce movement of said piston and of said elongated member;

said second valve means, when operated, serving to terminate movement of said piston and said elongated member, thereby accurately fixing the position of said movable member; and adjustment means connecting said elongated member with said piston, said adjustment means including a nut and said elongated member first portion having screw threads thereon for receiving said nut.

2. Apparatus as defined in claim 1 further including adjustable time delay means coupled with said second valve means to maintain said movable member at said position for a preselected interval of time.

3. Apparatus as defined in claim 1 further including restraining means which prevents rotation of said nut but permits rotation of said elongated member to axially position said nut along said first portion.

4. Apparatus as defined in claim 2 wherein said piston includes a portion engageable against said nut whereby piston movement after such engagement of said portion against said nut causes said nut and said elongated member to be moved to operate said valve actuating device.

5. Apparatus for stroke control in a hydraulic machine to accurately position a movable member in the machine, said apparatus comprising:

hydraulic fluid supply means;

a cylinder and piston assembly connected with said hydraulic fluid supply means;

said cylinder and piston assembly including a cylinder, a piston movable within said cylinder, a piston rod connected between said piston and said movable member, and hydraulic ports in said cylinder to enable hydraulic fluid to be supplied from said hydraulic fluid supply means to either side of said piston;

bore means extending through said piston and at least partially through said piston rod in an axial manner;

an elongated rod means including a first portion disposed in said bore means and a second portion projecting beyond said cylinder;

said first portion of said rod means having an abutment member adjustably mounted thereon;

said piston including a portion engageable with said abutment member when said piston is moved within said cylinder by said hydraulic fluid;

said elongated rod means being axially slidably coupled to said cylinder whereby movement of said piston after engagement of said portion against said abutment member will cause said rod means to move axially in the direction of piston movement;

first valve means and second valve means connected with said hydraulic supply;

valve actuating means carried by and movable with said second portion of said rod means;

said valve actuating means being engageable initially with said first valve means and subsequently with said second valve means to operate said valve means in sequence;

said operation of said first valve means causing a significant diminution of hydraulic fluid flow to said cylinder thereby significantly slowing the movement of said piston and hence of said movable member;

said operation of said second valve means causing said hydraulic fluid flow to said cylinder to be further reduced until hydraulic pressure on opposite sides of said piston is equalized whereupon movement of said piston and said movable member is terminated.

6. Apparatus as defined in claim 5 wherein said first portion of said rod means is externally threaded and wherein said abutment member is a nut mounted on said threaded first portion.

7. Apparatus as defined in claim 6 further including a key means within said bore means and a keyway in said nut, said key means disposed in said keyway to prevent said nut from rotating.

8. Apparatus as defined in claim 7 further including an adjusting member connected with said second portion of said rod means, said adjusting member being rotatable to hence rotate said rod means and thereby axially position said nut along the first portion thereof.

9. Apparatus as defined in claim 5 wherein said first valve means and said second valve means each include:

a valve member;

a valve seat;

a biasing spring urging said valve member against said valve seat to normally close said valve; and a projecting pin member coupled with said valve member, said projecting pin member being directed toward said valve actuating means.

10. Apparatus as defined in claim 9 wherein said valve actuating means includes a plate member having a pair of pins projecting therefrom toward said valve means, said projecting pins on said plate member being aligned with and engageable with said projecting pin members of said valve means.

11. Apparatus as defined in claim 10 wherein said pins projecting from said plate member are axially adjustable to permit selective control of the distance each pin projects beyond said plate member.

12. Apparatus as defined in claim 5 wherein said hydraulic fluid supply means includes:

first and second pump means for transmitting hydraulic fluid under pressure from a reservoir thereof;

first relief valve means connected between said first pump means and said first valve means;

second relief valve means connected between said second pump means and said second valve means;

a main control valve; and flowline means connecting said hydraulic ports in said cylinder through said main control valve and to said first and second pump means.

13. Apparatus as defined in claim 12 wherein said first valve means and said second valve means each includes an inlet and an outlet, said first valve means inlet being connected to said first relief valve means and said second valve means inlet being connected to said second relief valve means, said outlets from said first and second valve means being connected to said reservoir.

14. Apparatus as defined in claim 13 further including a pressure switch connected to said second valve means outlet and an adjustable time delay operated by said pressure switch when the pressure in said second valve means outlet reaches a predetermined magnitude, said time delay being operative to maintain said piston and said movable member at their final stopped position for a selected length of time.

15. In the combination of a hydraulic cylinder, a piston movably mounted within said cylinder and a piston rod projecting from said piston and beyond said cylinder to support a movable member; mechanism for accurately controlling the final position of said movable member, comprising:

a bore means extending through said piston and axially through a portion of said piston rod;

a rod means including a first portion in said cylinder and within said bore means and a second portion projecting beyond said cylinder;

said rod means being axially slidably mounted to said cylinder;

an abutment member adjustably attached to said first portion of said rod means and hence being disposed within said bore means;

said piston including a portion engageable against said abutment member as said piston moves forwardly within said cylinder, such engagement causing said abutment member to be moved forwardly by said piston and causing said rod means to slide axially forwardly in said cylinder;

first valve means and second valve means connected to a source of pressurized hydraulic fluid for said cylinder;

said first valve means and said second valve means each including a biasing spring normally urging the valve closed and a pin member which projects beyond the valve means under the biasing effect of said biasing spring;

a support member attached to said second portion of said rod means;

first and second actuating elements projecting from said support member toward said first and second valve means;

said first and second actuating elements being respectively aligned with and engageable with said first and second valve means projecting pin members;

said first actuating element having a projected length beyond said support member in excess of the projected length of said second actuating element whereby when said axial movement of said rod means moves said support member, said first actuating element will engage said projecting pin member of said first valve means to open said first valve means prior to the engagement of said second actuating element with the projecting pin member of said second valve means.

16. Mechanism as defined in claim 15 wherein said first portion of said rod means is threaded and wherein said abutment member is a nut attached to said threaded portion.

17. Mechanism as defined in claim 16 wherein said bore means includes an axially extending rib and wherein said nut has a peripheral groove through which said rib extends to prevent rotation of said nut.

18. Mechanism as defined in claim 17 further including a pinion attached to said rod means second portion, said pinion being driven in a rotary manner to thus rotate said rod means thereby causing said nut to move axially along said threaded first portion.

19. Mechanism as defined in claim 15 wherein said first valve means and said second valve means eahc include an outlet port and conduit means to permit hydraulic fluid to pass through said valve means when they are opened and to return to the source of hydraulic fluid.

20. Mechanism as defined in claim 19 wherein the conduit means from said second valve means includes a check valve which opens only when the pressure thereagainst reaches a predetermined magnitude.

21. Mechanism as defined in claim 20 wherein said check valve is provided with a small bleed orifice therethrough to permit a small amount of hydraulic fluid to flow through said check valve even before the pressure in said conduit means is of sufficient magnitude to open said check valve.

22. Mechanism as defined in claim 20 further including a pressure switch, an adjustable time delay device operable by said pressure switch, and a branch conduit connecting said pressure switch with said conduit means.

23. Mechanism as defined in claim 22 wherein said branch conduit connects with said conduit means between said check valve and said second means outlet port.

24. In a stroke control apparatus for a hydraulic press of the type which includes a movable member, apparatus comprising:

a source of hydraulic fluid;

control valve means;

pump means;

a cylinder;

a piston movable within said cylinder;

a piston rod connecting said piston to said movable member;

conduit means connecting said pump means to said source and to said control valve means, and connecting said control valve means to said cylinder to permit said pump means to deliver hydraulic fluid under pressure to said cylinder to cause movement of said piston within said cylinder;

first valve means having an inlet and an outlet;

second valve means having an inlet and an outlet;

first master relief valve means;

second master relief means;

a first flowline connecting said first master relief valve with said first valve means inlet;

a second flowline connecting said second master relief valve with said second valve means inlet;

flow conduit means connecting said first and second master relief valves with said pump means;

outflow lines connecting said outlets from said first valve means and said second valve means to said source;

discharge lines connecting said first and second master relief valves with said source;

actuating means for opening said first valve means and for subsequently opening said second valve means; said actuating means being arranged to open said second valve means only after said first valve means has been opened; and adjustable control means operatively connected between said piston and said actuating means whereby movement of said piston within said cylinder will cause movement of actuating means to initially open said first valve means and then to open said second valve means.

25. Apparatus as defined in claim 24 wherein said adjustable control means includes an elongated rod means having a first portion disposed within said cylinder and having a second portion extending beyond said cylinder, said second portion carrying said actuating means.

26. Apparatus as defined in claim 25 further including an abutment member adjustably mounted on said first portion of said rod means, said abutment member being engageable by said piston as said piston moves within said cylinder.

27. Apparatus as defined in claim 26 further including a pressure switch and an adjustable time delay actuated by said pressure switch, said pressure switch being connected to said outflow line from said second valve means.

* * * * *